US009157210B2

(12) United States Patent
Patti

(10) Patent No.: US 9,157,210 B2
(45) Date of Patent: Oct. 13, 2015

(54) ARCHITECTURAL WALL DRAIN ASSEMBLY

(71) Applicant: Anthony Patti, Highland Park, NJ (US)

(72) Inventor: Anthony Patti, Highland Park, NJ (US)

( * ) Notice: Subject to any disclaimer, the term of this patent is extended or adjusted under 35 U.S.C. 154(b) by 96 days.

(21) Appl. No.: 14/212,641

(22) Filed: Mar. 14, 2014

(65) Prior Publication Data

US 2014/0261769 A1 Sep. 18, 2014

Related U.S. Application Data

(60) Provisional application No. 61/799,997, filed on Mar. 15, 2013.

(51) Int. Cl.
*E02D 17/20* (2006.01)

(52) U.S. Cl.
CPC ..... *E02D 17/205* (2013.01); *Y10T 137/698* (2015.04)

(58) Field of Classification Search
CPC ..... E02D 17/205; Y10T 137/698
USPC ..... 137/360, 361, 362; 405/42; 210/163; 52/302.1–302.7
See application file for complete search history.

(56) References Cited

U.S. PATENT DOCUMENTS

| | | | | |
|---|---|---|---|---|
| 1,123,888 | A * | 1/1915 | Kempf | 405/42 |
| 1,853,321 | A | 4/1932 | Rogers | |
| 2,038,506 | A | 4/1936 | Cadieux | |
| 3,007,034 | A | 10/1961 | Reed et al. | |
| 3,096,782 | A * | 7/1963 | Williams | 137/360 |
| 3,824,524 | A | 7/1974 | Glover | |
| 4,167,196 | A * | 9/1979 | Morris | 137/360 |
| 4,223,377 | A | 9/1980 | Williams | |
| 4,382,274 | A | 5/1983 | De Backer et al. | |
| 4,396,972 | A | 8/1983 | Kaneko et al. | |
| 4,449,167 | A | 5/1984 | Cohen | |
| 4,635,167 | A | 1/1987 | Schlosser | |
| 4,697,950 | A | 10/1987 | Copeland | |
| 4,700,277 | A | 10/1987 | Moore | |
| D293,133 | S | 12/1987 | Wood | |
| 4,744,014 | A | 5/1988 | Harris | |

(Continued)

FOREIGN PATENT DOCUMENTS

| | | |
|---|---|---|
| CA | 2492501 | 7/2005 |
| CA | 2591736 | 12/2007 |
| CA | 2654119 | 8/2009 |

OTHER PUBLICATIONS

Product Sheet from Cast Lighting LLC for Cast Engineered Wall Light Product Information (CEWL5CB) 1 page, Copyright 2008.

(Continued)

*Primary Examiner* — Craig Schneider
*Assistant Examiner* — Daniel P Donegan
(74) *Attorney, Agent, or Firm* — Greenberg Traurig, LLP

(57) ABSTRACT

A drain cover assembly includes a face plate having at least one hole to allow water to flow from a drainage pipe located in a retaining wall. The face plate includes a first pair of flanges and a second pair of flanges, both of which extend substantially perpendicular to the face plate. The first pair of flanges has a receiving means for receiving a fastener adapted to secure the drain cover assembly to the retaining wall. The second pair of flanges has a plurality of deformable tabs adapted to create an interference fit with the retaining wall. The drain cover assembly may also include a decorative face plate.

1 Claim, 5 Drawing Sheets

(56) References Cited

U.S. PATENT DOCUMENTS

| | | | | |
|---|---|---|---|---|
| 4,779,324 | A | 10/1988 | Sandor, Sr. | |
| 4,851,977 | A | 7/1989 | Gary | |
| 4,888,669 | A | 12/1989 | Hanson | |
| 4,912,610 | A | 3/1990 | Dahlberg | |
| 4,931,915 | A | 6/1990 | Quiogue | |
| 4,974,134 | A | 11/1990 | Bourne | |
| 4,992,914 | A | 2/1991 | Heiss et al. | |
| 5,029,054 | A | 7/1991 | Trainor | |
| D328,502 | S | 8/1992 | Hartman | |
| 5,156,454 | A | 10/1992 | White | |
| 5,160,202 | A | 11/1992 | Legare | |
| 5,249,108 | A | 9/1993 | Gary | |
| 5,335,151 | A | 8/1994 | Dahlberg | |
| 5,390,090 | A | 2/1995 | Nau | |
| 5,425,600 | A * | 6/1995 | Gordon | 405/284 |
| 5,481,443 | A | 1/1996 | Wagner et al. | |
| 5,503,181 | A * | 4/1996 | Kennedy | 137/362 |
| D376,657 | S | 12/1996 | Bohn | |
| 5,678,920 | A | 10/1997 | Kerr | |
| 5,683,170 | A | 11/1997 | Blaha | |
| 5,743,622 | A | 4/1998 | Ibbitson et al. | |
| 5,778,625 | A | 7/1998 | Druffel et al. | |
| 5,779,349 | A | 7/1998 | Reinert, Sr. | |
| 5,908,263 | A | 6/1999 | Conners et al. | |
| 5,924,790 | A | 7/1999 | Ponton et al. | |
| 5,943,827 | A | 8/1999 | Okerlund | |
| 5,951,144 | A | 9/1999 | Gavigan et al. | |
| 6,027,280 | A | 2/2000 | Conners et al. | |
| 6,065,853 | A | 5/2000 | Crevier | |
| 6,068,384 | A | 5/2000 | Tyson et al. | |
| 6,179,435 | B1 | 1/2001 | Wilson | |
| 6,231,206 | B1 | 5/2001 | Hervey et al. | |
| 6,231,272 | B1 * | 5/2001 | Bishop | 405/286 |
| 6,334,695 | B1 | 1/2002 | Abe et al. | |
| 6,547,589 | B2 | 4/2003 | Magyar et al. | |
| 6,565,239 | B2 | 5/2003 | Rizkin et al. | |
| 6,578,321 | B2 | 6/2003 | Layne | |
| 6,648,546 | B1 | 11/2003 | Abe et al. | |
| 6,665,986 | B1 | 12/2003 | Kaplan | |
| 6,796,684 | B1 | 9/2004 | Beadle | |
| 6,866,032 | B2 | 3/2005 | Magyar et al. | |
| 6,881,094 | B2 | 4/2005 | Magyar et al. | |
| 6,976,765 | B2 | 12/2005 | Helenowski | |
| 7,033,038 | B2 | 4/2006 | Hagen | |
| 7,070,294 | B2 | 7/2006 | Patti | |
| 7,234,846 | B2 | 6/2007 | Chen | |
| 7,290,904 | B2 | 11/2007 | Miller | |
| D564,128 | S | 3/2008 | Hartman | |
| D570,037 | S | 5/2008 | Hartman | |
| D574,106 | S | 7/2008 | Hartman | |
| D576,763 | S | 9/2008 | Hartman | |
| 7,524,077 | B2 | 4/2009 | Hartman | |
| 7,556,394 | B2 | 7/2009 | Patti | |
| 8,002,447 | B2 | 8/2011 | Patti | |
| 8,066,398 | B2 | 11/2011 | Hartman | |
| D651,336 | S | 12/2011 | Hartman | |
| 2003/0048634 | A1 | 3/2003 | You et al. | |
| 2003/0156405 | A1 | 8/2003 | Kim | |
| 2004/0252489 | A1 | 12/2004 | Hagen | |
| 2006/0114680 | A1 | 6/2006 | Miller | |
| 2007/0263396 | A1 | 11/2007 | Miller | |
| 2008/0062679 | A1 | 3/2008 | Hartman | |
| 2009/0213580 | A1 | 8/2009 | Hartman | |

OTHER PUBLICATIONS

"Product Update", Vista Professional Outdoor Lighting, 1 page, published prior to Jul. 9, 2007.

Product Sheet from HUMZA Productions, Ltd., Auckland, New Zealand, 1 page, undated.

Newsletter, "Landscape Lifestyles", No. 7, copyright 2005, Allan Block Corporation, MN, 6pp. viewed on Mar. 10, 2008 at <http://www.allanblock.com/retainingwalls/newsletter/.

Photograph of light fixture by Integral Lighting, Wernersville, PA, bottom view, undated.

* cited by examiner

ARCHITECTURAL WALL DRAIN ASSEMBLY

CROSS-REFERENCE TO RELATED APPLICATIONS

This application claims the benefit of U.S. Provisional Patent Application No. 61/799,997 filed Mar. 15, 2013, which is incorporated by reference herein in its entirety.

FIELD OF INVENTION

The present invention relates to architectural walls and, more particularly, to walls that require periodic evacuation of water.

BACKGROUND OF THE INVENTION

Retaining walls used to retain soil and the like must have drainage aggregate, and a perforated drain pipe that leads to daylight for the sole purpose of draining water out from behind the wall. Water that is not drained from behind retaining walls can cause mass slope failure, and heaving of the wall if it were to freeze.

In architectural walls and other similar types of retaining walls which are made from a plurality of stackable block-like elements, drainage holes are often provided in the wall to facilitate the evacuation of water from the soil behind the wall. Commonly, such holes are provided with drainage pipes that further facilitate the evacuation of water. In the above-described installations, the hole is typically cut in a square shape while the pipe is round, leaving unsightly empty spaces or void areas between the pipe and the surrounding wall. These spaces or void areas often collect garbage and other debris, and rodents tend to nest in the drainage holes, making these drain pipes even more of an eyesore, as well as a nuisance.

SUMMARY OF THE INVENTION

A combination according to the present invention includes (1) a retaining wall including a plurality of wall blocks; (2) a drainage pipe located within a drainage hole disposed between at least a pair of wall blocks and forming voids between the drainage pipe and the pair of wall blocks; and (3) a drain cover assembly. The drain cover assembly includes a face plate that has a first portion and a second portion. The first portion has at least one hole positioned so as to be in general alignment with the drainage pipe to allow water to flow from the drainage pipe through the hole(s). The second portion is positioned so as to cover the voids to thereby inhibit collection of debris in the voids. The drain cover assembly also includes a first pair of flanges extending from the face plate in a substantially perpendicular orientation and positioned opposite each other, and having flanges with receiving means for receiving a fastener adapted to secure the drain cover assembly to at least a pair of wall blocks, and a second pair of flanges extending from the face plate in a substantially perpendicular orientation and positioned opposite one another. The second pair of flanges has deformable tabs engagable with at least a pair of wall blocks in an interference fit.

BRIEF DESCRIPTION OF DRAWINGS

For a more complete understanding of the present invention, reference is made to the following detailed description of various exemplary embodiments considered in conjunction with the accompanying drawings, in which.

DETAILED DESCRIPTION OF THE EXEMPLARY EMBODIMENTS

Figure 1:
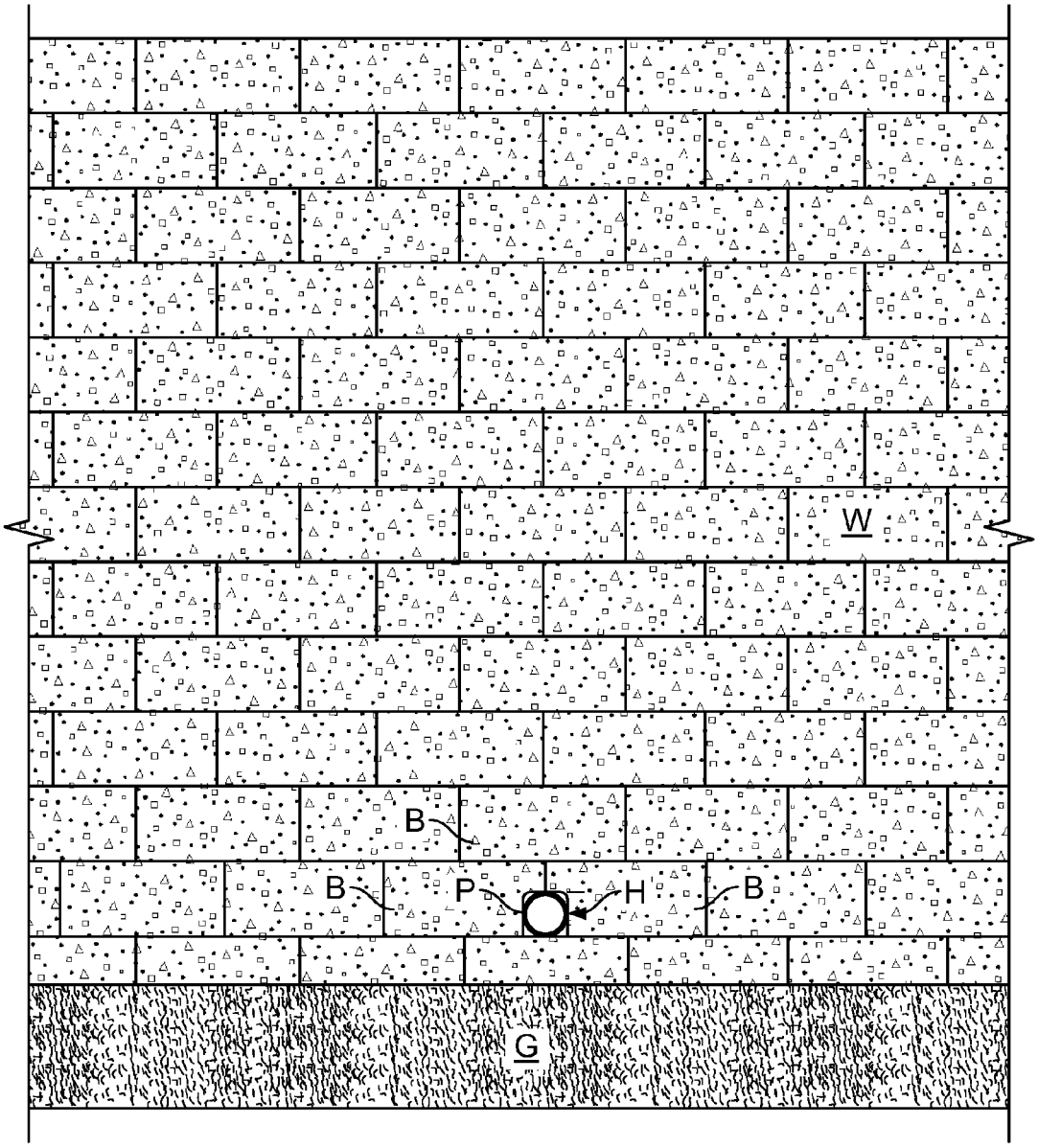
FIG. 1 is a front view of an architectural wall with a drainage hole cut out and a drainage pipe installed therein.
Figure 2:
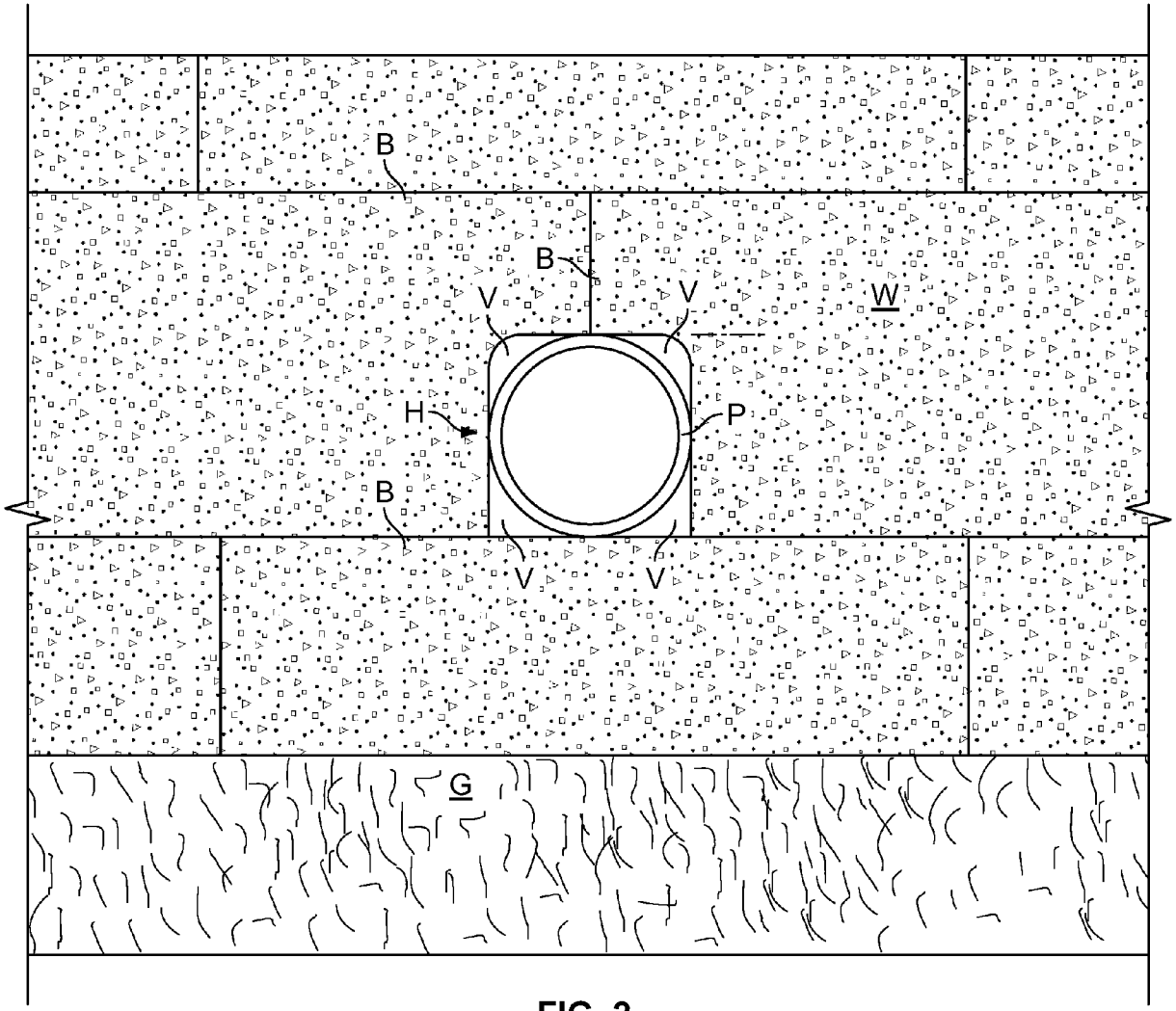
FIG. 2 is a front view the architectural wall shown in FIG. 1, providing a more detailed view of the drainage pipe.

With reference to FIGS. 1 and 2, an architectural wall W is made from blocks B. A drainage hole H is cut out close to the ground G and a drainage pipe P is installed therein. As drainage pipe P is round and hole H is typically square or rectangular in shape, voids V (see FIG. 2) are created between the pipe P and the surrounding wall W. The standard drain pipe in the industry is generally made of a plastic, e.g., HDPE (high density polyethylene) or the like, and with a diameter of 4 inches. The standard drain pipe is also typically corrugated and perforated. Similar pipes are manufactured by National Drain Systems or Advanced Drain Systems.

Figure 3:
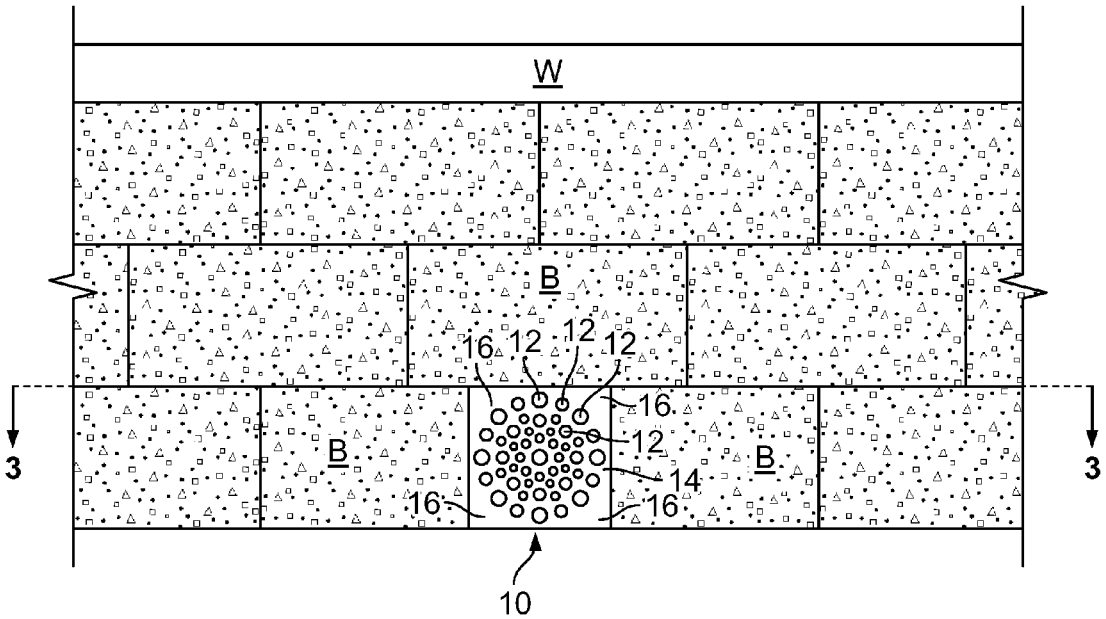
FIG. 3 is a front elevational view of an architectural wall similar to the one depicted in FIGS. 1 and 2, but with a drain cover assembly according to the present invention installed in the drainage hole.
Figure 4:
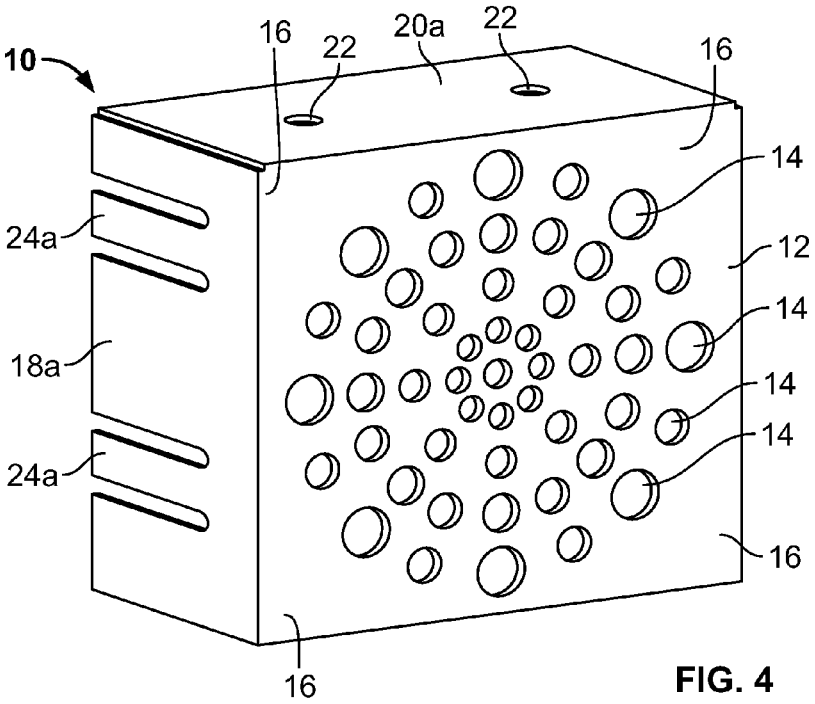
FIG. 4 is a front perspective view of the drain cover assembly shown in FIG. 3, the drain cover assembly being constructed in accordance with one exemplary embodiment of the present invention.

With reference to FIGS. 3 and 4, a drain cover assembly 10 is a monolithic structure having a face plate 12 with a plurality of holes 14 configured to allow the outflow of water from a pipe. In the depicted embodiment, the holes 14 extend radially from the center of the face plate 12 and terminate a sufficient distance from the edge of the face plate 12 so as to form obstructed corners 16. This configuration allows water to flow out from pipe P (not shown, but see FIGS. 1 and 2), while the corners 16 of the face plate 12 prevent debris and other matter from collecting in the voids V (not shown, but see FIG. 2). In an embodiment, the face plate 12 of the drain cover assembly 10 is formed as a 6 inch by 6 inch square, thereby matching the standard height of at least one type of architectural wall block. In this embodiment, the drain cover assembly 10 may be mounted in hole H of the wall W such that it sits flush against surrounding blocks B, as shown in FIG. 3.

With specific reference to FIG. 4, the drain cover assembly 10 includes two vertical side flanges 18*a*, 18*b* (only 18*a* is visible in FIG. 4) extending from the face plate 12 at a substantially 90 degree angle relative to the plane of the face plate 12, and positioned opposite one another. The drain cover assembly 10 further includes upper and lower horizontal flanges 20*a*, 20*b* (only 20*a* is visible in FIG. 4) extending from the face plate 14 at a substantially 90 degree angle relative to the plane of the face plate 14, and positioned opposite one another. The flanges 18*a*, 18*b*, 20*a*, 20*b* are adapted to extend a sufficient distance from the face plate 14 so as to allow the drain cover assembly 10 to provide structural support for the wall W, including block B located above the drain cover assembly 10. Each of the flanges 20*a*, 20*b* has a pair of holes 22 to allow the drain cover assembly 10 to be anchored to adjacent blocks B with screws (not shown) for a more permanent installation.

Figure 5:
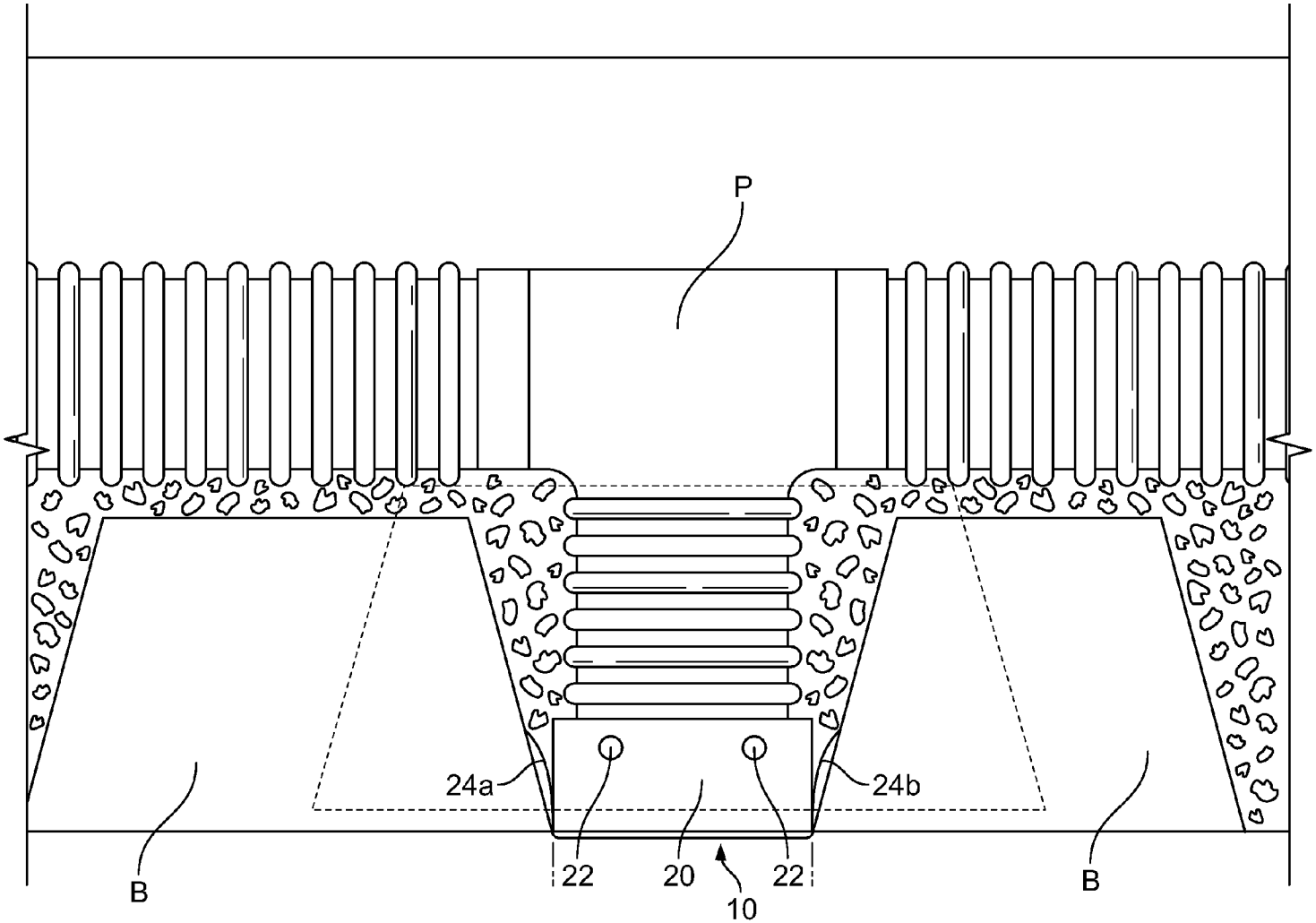
FIG. 5 is a cross-sectional view of the drain cover assembly of FIG. 4, taken along section line 3-3 of FIG. 3 and looking in the direction of the arrows.

If a temporary installation of the assembly 10 is desired, each of the flanges 18*a*, 18*b* may be provided with a pair of deformable tabs 24*a*, 24*b*, respectively, which can be bent outwardly to anchor the drain cover assembly 10 to the surrounding blocks B, as shown in FIG. 5. The tabs 24*a*, 24*b* are adapted to create an interference fit with the surrounding blocks B so as to retain the drain cover assembly 10 solidly within the wall W. This allows the drain cover assembly 10 to be mounted quickly and to be removed without the use of additional tools. As shown in FIG. 5, the pipe P and drain cover 10 may be placed between the two blocks B, rather than cutting a separate drainage hole through one or more blocks.

Figure 6:
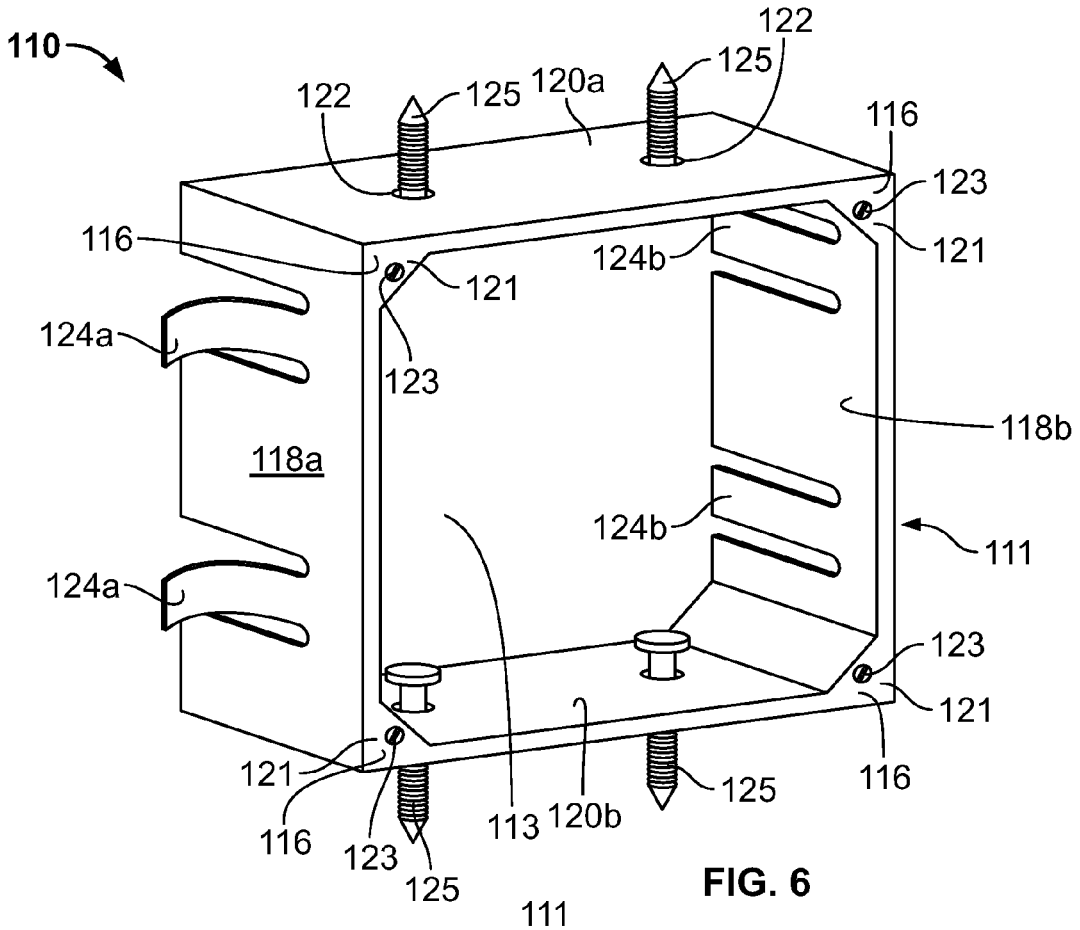
FIG. 6 is a front perspective view of a mounting frame for an alternate exemplary embodiment of the present invention.
Figure 7:
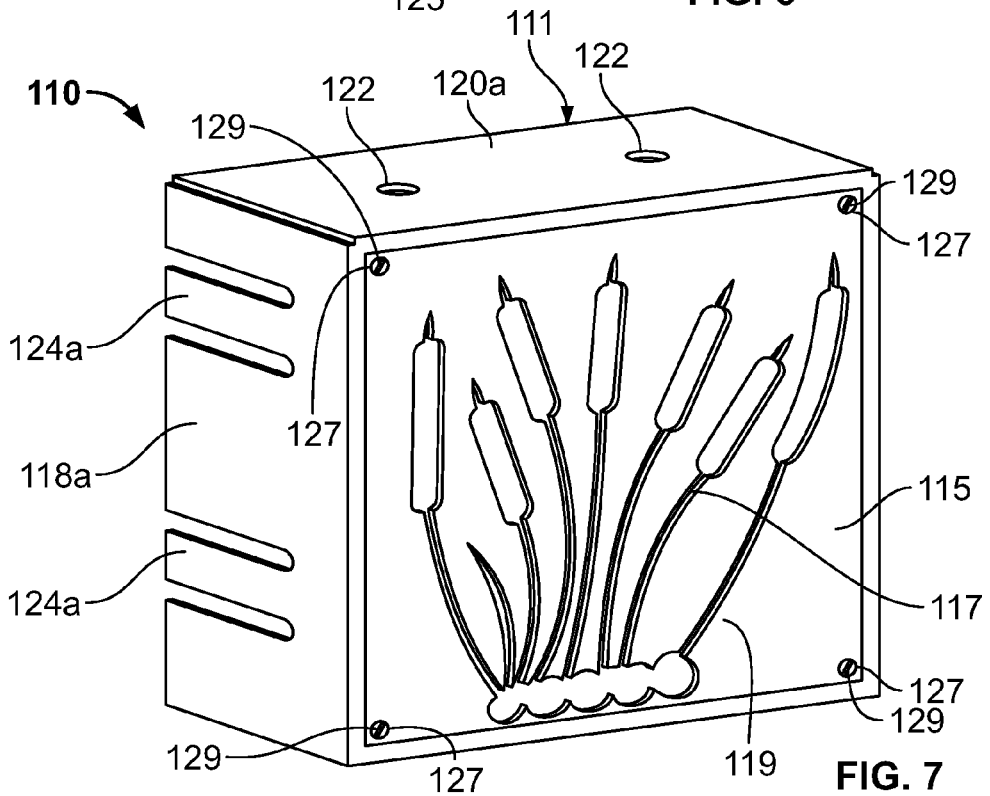
FIG. 7 is a front perspective view of a decorative face plate adapted for use with the mounting frame depicted in FIG. 6.

An alternative exemplary embodiment of the present invention is illustrated in FIGS. 6 and 7. The elements illustrated in FIGS. 6 and 7, which correspond to the elements described above with reference to FIGS. 3-5, have been designated by corresponding reference numerals increased by one hundred, while new elements are designated by odd reference numerals in the one hundreds. The embodiment shown in FIGS. 6 and 7 operates and is constructed in a manner consistent with the embodiment of FIGS. 3-5, unless otherwise indicated.

Referring now to FIGS. 6 and 7, a drain cover assembly 110 comprises a square mounting frame 111 with an open front face 113 having corners 116 and a decorative face plate 115 having a face 119 and a logo or design 117 thereon (see FIG. 7). The mounting frame 111 has an angled boss 121 in each corner 116 and an internally threaded hole 123 in the boss 121. Similar to the monolithic embodiment of the present invention shown in FIGS. 3-5, the drain cover assembly 110 includes vertical side flanges 118*a*, 118*b*, each of the vertical side flanges 118*a*, 118*b* having a pair of deformable tabs 124*a*, 124*b*, respectively, thereby enabling the mounting frame 111 to be interference fit within the wall without requiring a more permanent affixation. Similarly, the drain cover assembly 110 includes upper and lower horizontal flanges 120*a*, 120*b*. Each of the horizontal flanges 120*a*, 120*b* includes two holes 122 configured to allow the frame to be anchored to the surrounding wall with screws 125. FIG. 6 depicts the tabs 124*a* in their engaged position, in which they are bent outwardly to anchor the mounting frame 111 against the surrounding blocks (not shown). FIG. 7 depicts the tabs 124*b* in their unbent position, in which they remain in substantially the same plane as vertical side flange 118*b*.

Still referring to FIGS. 6 and 7, the corners 116 of the front face 113 each include a threaded hole 127 to communicate with a screw 129 for fixed attachment of the decorative face plate 115 after the drain cover assembly 110 has been installed. In an embodiment, a hinge (not shown) may be employed to affix the face plate 115 to the mounting frame 111 so that debris may be conveniently removed.

It should be noted that the present invention can have numerous modifications and variations. For instance, an embodiment of the present invention provides a mechanical connection between the pipe P and the wall drain cover assembly 10. Such an embodiment serves to anchor the free end of the pipe P, which is particularly useful when the dimensions of the face plates 12, 113 are greater than the diameter of the pipe P. An adapter is provided to connect the drain cover assembly 10 to the end of the pipe P. The adapter has a first end with a round shape that allows the first end to fit closely over the end of the pipe P. The second end of the adapter, which is opposite the first end, has one or more flanges by which the adapter can be fastened to the drain cover assembly 10. In some embodiments, the second end has a diameter greater than the first end, such that the adapter has the general appearance of a funnel. In such embodiments, the second end of the adapter may have a size and shape selected to substantially match the dimensions of the face plate (e.g., the diameter or width/length of an adapter designed for use with a 6-inch square face plate may have a diameter of or slightly less than 6 inches).

It will be understood that the embodiments described herein are merely exemplary and that a person skilled in the art may make many variations and modifications without departing from the spirit and scope of the invention. All such variations and modifications are intended to be included within the scope of the invention and the appended claims.

What is claimed is:

1. In combination, a retaining wall including a plurality of wall blocks; a drainage pipe located within a drainage hole disposed between at least a pair of said wall blocks and forming voids between said drainage pipe and said at least a pair of said wall blocks; and a drain cover assembly positioned in said drainage hole in front of said drainage pipe, said drain cover assembly including a face plate having a first portion and a second portion, said first portion having at least one hole positioned so as to be in general alignment with said drainage pipe to allow water to flow from said drainage pipe through said at least one hole, and said second portion being positioned so as to cover said voids to thereby inhibit collection of debris in said voids, a first pair of flanges extending from said face plate in a substantially perpendicular orientation and positioned opposite each other, said first pair of flanges having receiving means for receiving a fastener adapted to secure said drain cover assembly to said at least a pair of said wall blocks, and a second pair of flanges extending from said face plate in a substantially perpendicular orientation and positioned opposite one another, said second pair of flanges having deformable tabs engagable with said at least a pair of said wall blocks in an interference fit.

* * * * *